US008118250B1

(12) United States Patent
Helseth et al.

(10) Patent No.: US 8,118,250 B1
(45) Date of Patent: Feb. 21, 2012

(54) FUEL TANKER TRUCK ACCESSORY AND ASSOCIATED METHODS

(76) Inventors: Andrew Helseth, Deland, FL (US); Jon Thibeault, Orlando, FL (US)

( * ) Notice: Subject to any disclaimer, the term of this patent is extended or adjusted under 35 U.S.C. 154(b) by 989 days.

(21) Appl. No.: 12/098,495

(22) Filed: Apr. 7, 2008

(51) Int. Cl.
*B65H 23/06* (2006.01)

(52) U.S. Cl. ..... 242/396.5; 242/379; 242/397.5; 242/615.2

(58) Field of Classification Search ..... 242/371, 242/379, 381.1, 396.5, 397.5, 588.2, 615.2, 242/532.5–532.6, 580, 615.3
See application file for complete search history.

(56) References Cited

U.S. PATENT DOCUMENTS 4,390,141 A * 6/1983 Webster ..... 242/404.2
5,033,690 A * 7/1991 McIver ..... 242/532.6
5,505,404 A * 4/1996 Dubreuil ..... 242/532.6
5,655,728 A * 8/1997 Yang ..... 242/395.1
6,142,701 A * 11/2000 Falcon ..... 404/6
6,439,492 B1 * 8/2002 Leiggi ..... 242/379
7,217,061 B2 * 5/2007 Stratton ..... 404/6

* cited by examiner

*Primary Examiner* — Sang Kim
(74) *Attorney, Agent, or Firm* — Allen, Dyer, Doppelt, Milbath & Gilchrist, P.A.

(57) ABSTRACT

The invention provides a fuel tanker truck accessory and a method of delivering fuel to a storage tank. The accessory is intended for permanently mounting on the truck and has a spool containing a roll of warning strap. The method includes attaching a plurality of the accessories containing rolls of warning strap to the fuel tanker truck; stationing the fuel tanker truck near the storage tank; extending one or more of the warning straps from the spools so as to define a fuel delivery operations area between the tanker truck and the storage tank and restrict passage therethrough; connecting a fuel delivery hose from the tanker truck to the storage tank so that the hose extends through the fuel delivery operations area; and delivering fuel through the hose to the storage tank.

2 Claims, 6 Drawing Sheets

FUEL TANKER TRUCK ACCESSORY AND ASSOCIATED METHODS

FIELD OF THE INVENTION

The present invention relates primarily to the field of fuel delivery and, more particularly, to an accessory for a fuel delivery tanker truck, the accessory having a warning strap which extends from the tanker to visually define a restricted access area within which fuel is being transferred and its associated methods.

BACKGROUND OF THE INVENTION

Fuel delivery tanker trucks typically resupply automotive fuel service stations on an as-needed basis. The tanker truck is stationed somewhere on the property of the service station near fill pipes for underground storage tanks (UST). The tanker driver opens the access door to the UST, deploys fuel delivery hoses, connects the hoses to the tanker outlets and delivers fuel from the tanker to the UST. Because most service stations are quite busy with motor vehicle traffic, an automobile or other motorized vehicle will often run over the fuel delivery hoses causing at least damage to the hoses. Of more serious concern is the possibility that a vehicle running over a hose may cause the hose to accidentally disconnect while delivering fuel, thus causing a sudden fuel spill, which could be not only environmentally damaging and potentially explosive, but also quite expensive to clean. Moreover, by traversing the area in which the fuel transfer operation is taking place, a motor vehicle could also run over, hit or otherwise cause injury to the tanker truck driver or service station personnel. To date, there has been no effective way to discourage drivers from running over fuel delivery hoses.

SUMMARY OF THE INVENTION

With the foregoing in mind, the present invention advantageously provides a method of resupplying fuel to a storage tank, particularly an underground storage tank (UST) in an automobile service station. The method relies on an accessory for a fuel tanker truck. The accessory serves to house a warning strap which may be extended therefrom to define a restricted access area within which one or more fuel hoses are deployed for the fuel transfer operation.

A method of the invention, in one embodiment, includes delivering fuel from a fuel tanker truck to an underground storage tank (UST) at a service station. The method calls for stationing the tanker truck near a fill inlet of the storage tank. A warning strap carried by the tanker truck is extended toward the fill inlet of the storage tank and an end of the warning strap is releasably secured to an object near the fill inlet. A fuel hose is deployed from the tanker truck extending generally codirectionally with the warning strap and the hose is connected to the fill inlet of the storage tank. The fuel hose is also connected to an outlet valve on the tanker truck. An outlet valve on the fuel tanker is opened to deliver fuel through the fuel hose to the storage tank.

In another method, a restricted access operations area is visually defined by pulling the warning strap carried by the tanker truck and extending the warning strap toward the UST, releasably attaching an end of the warning strap to a support near the UST. A fuel hose is deployed from the tanker truck extending generally in the direction of the warning strap and is then connected to the fill inlet of the UST. The hose is also connected to an outlet valve on the tanker truck and an outlet valve is opened to deliver fuel from the tanker truck through the fuel hose to the UST.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, any materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

FIGS. 1 through 6 illustrate an accessory configured specifically for being bolted or otherwise permanently attached to a fuel tanker truck, as described above, and its associated methods. The accessory contains a warning strap which may be extended from the tanker truck to cordon-off an area.

Figure 1:
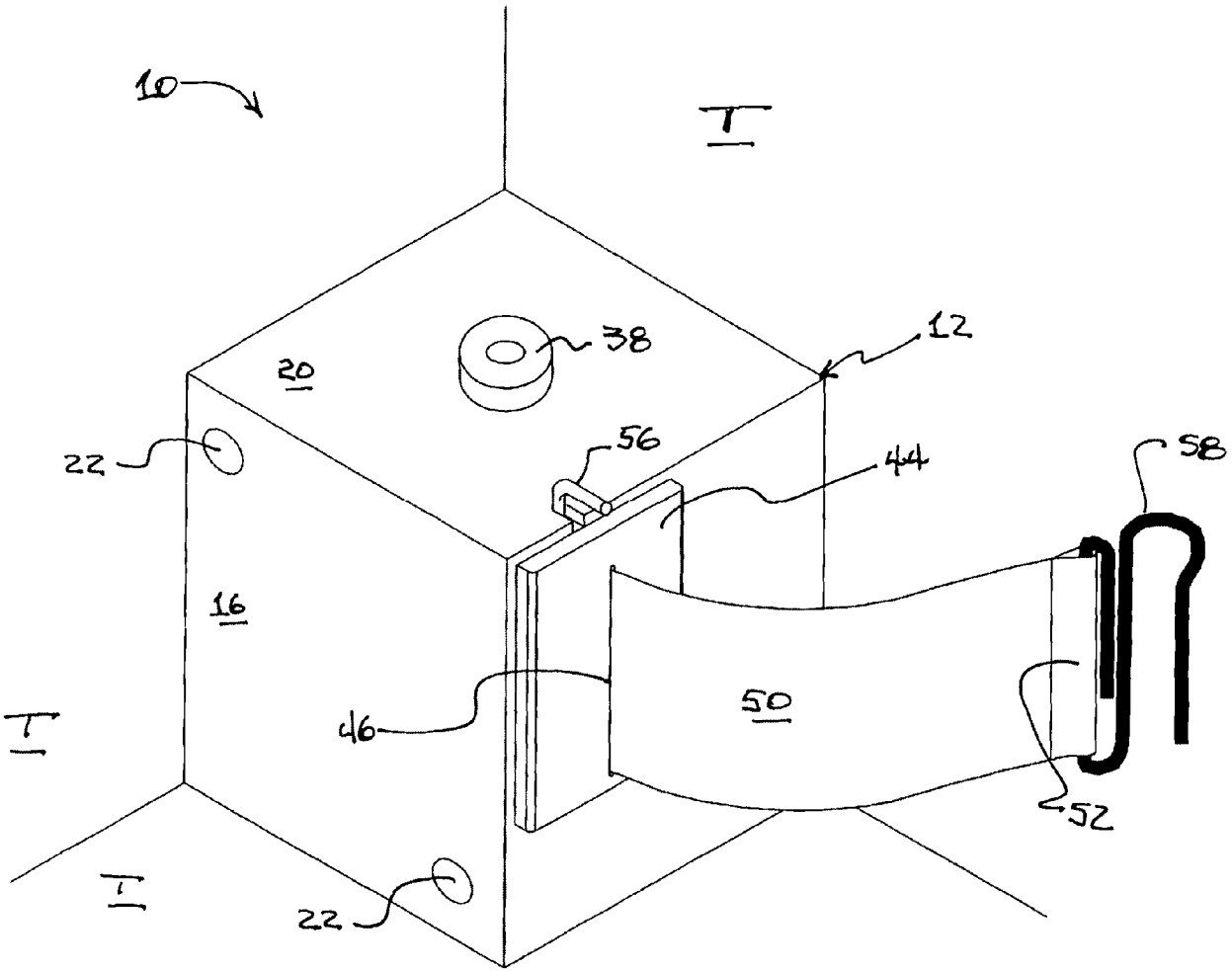
FIG. 1 is a perspective view of the accessory installed on a tanker truck, according to an embodiment of the present invention.
Figure 2:
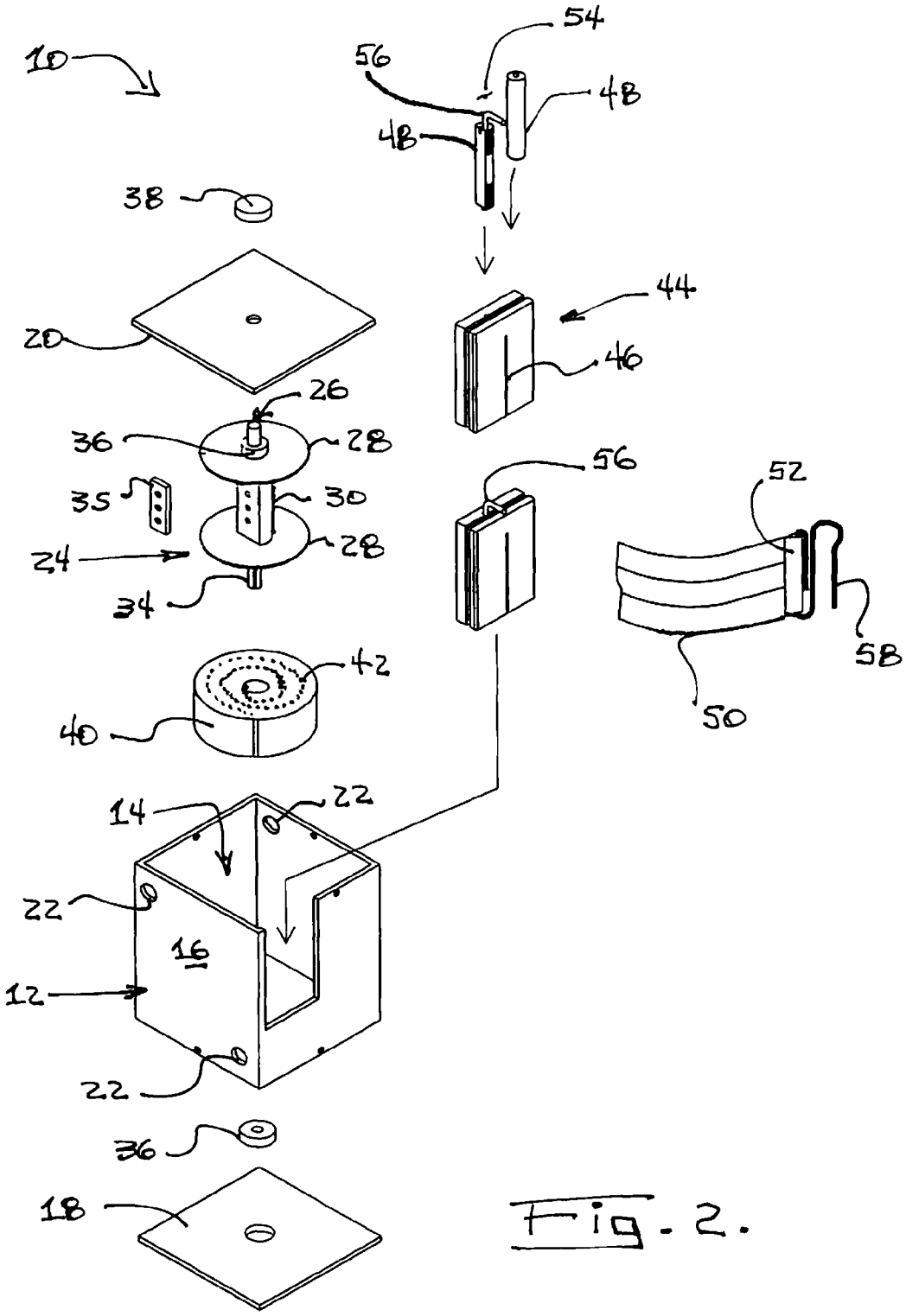
FIG. 2 provides an exploded view of the tanker truck accessory shown in FIG. 1.
Figure 3:
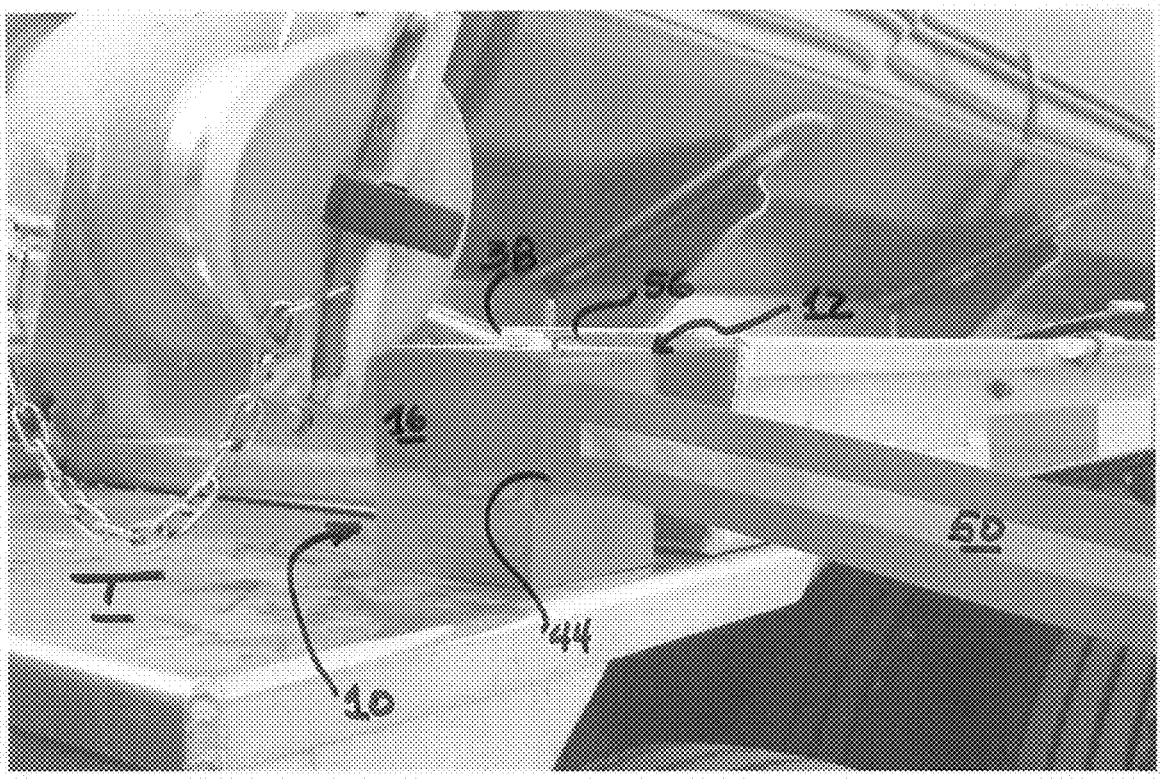
FIG. 3 depicts the accessory of FIG. 1 installed on a tanker truck and having the warning strap extended.

FIGS. 1-3, show views of the present invention which discloses an accessory 10 for a tanker truck, now described in more specific detail with particular reference to the exploded view shown in FIG. 2. The accessory 10 of the invention comprises an outer housing 12 having an inner cavity 14 defined by one or more side walls 16, a bottom cover 18, a top cover 20 and a plurality of openings 22 extending through said outer housing to therein matingly receive a plurality of fasteners (not shown). Housing 12 and, generally, the component parts of the present invention may be manufactured of 6061 aluminum, for durability. As seen in FIGS. 1 and 3, the accessory 10 is preferably attached to a tanker truck, the connection preferably being effected by connecting threaded fasteners through the openings 22 in the outer housing 12. In the outer housing 12 is a spool 24 having an axial shaft 26 and top and bottom spaced apart endplates 28, said shaft having a center portion 30 between said endplates, a top end 32 extending through the top cover 20 and a bottom end 34 rotatably associated with the bottom cover so as to support said spool within the inner cavity of said outer housing. A strap anchor plate 35 is associated with the center portion 30 of the axial shaft 26 of said spool 24. Top and bottom bearings 36 are concentrically disposed respectively on the top 32 and bottom 34 shaft ends between the spool endplates 28 and the associated top 20 and bottom 18 outer housing covers so as to aid said spool 24 to rotate about the axial shaft 26. Bearings 36 are preferably manufactured of high quality stainless steel.

A rotatable member 38, which may be a thumbwheel, as best shown in FIGS. 1 and 2, is attached to a spool shaft end 32 which extends through the top cover 20 so as to permit manual rotation of said spool 24. A coil spring housing 40 is disposed on the bottom end 34 of said axial shaft 25 between the bottom spool endplate 28 and the bottom bearing 36. A coil spring 42 is positioned in said coil spring housing 40 and engaged with said axial shaft 26 so as to bring a biasing force to bear thereon.

Figure 4:
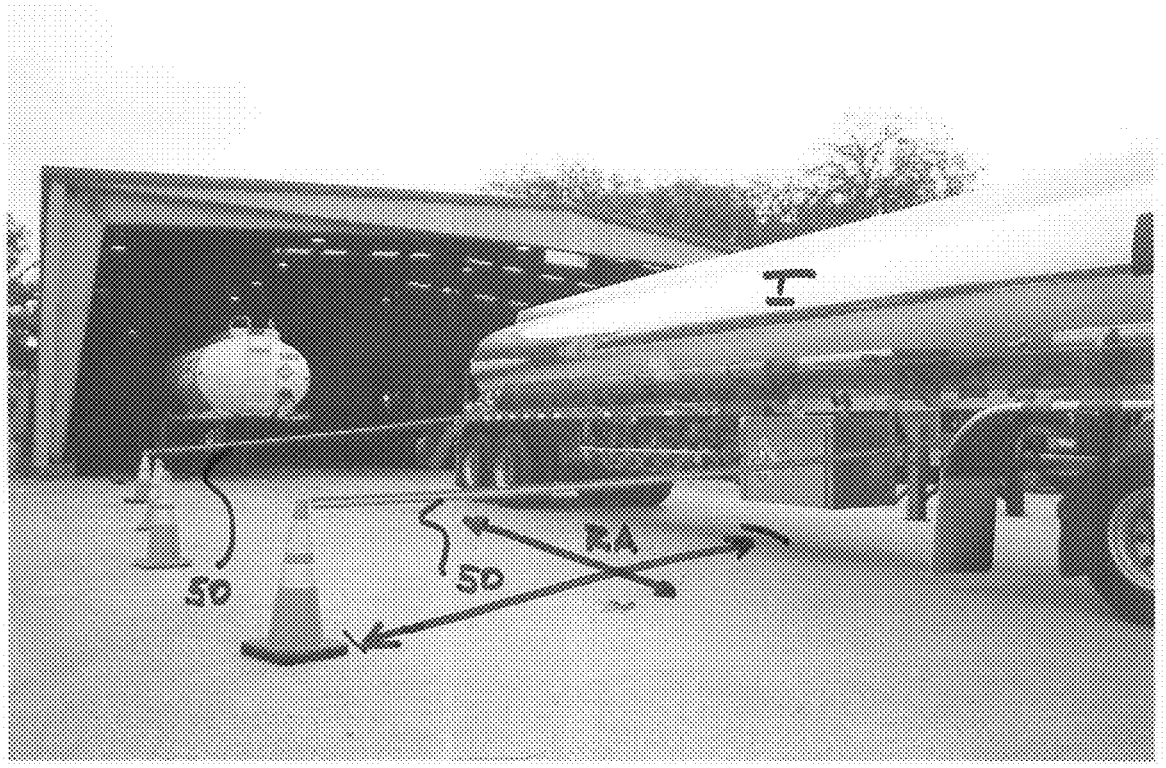
FIG. 4 shows an environmental view of the present invention visually defining a restricted access fuel delivery operations area.
Figure 5:
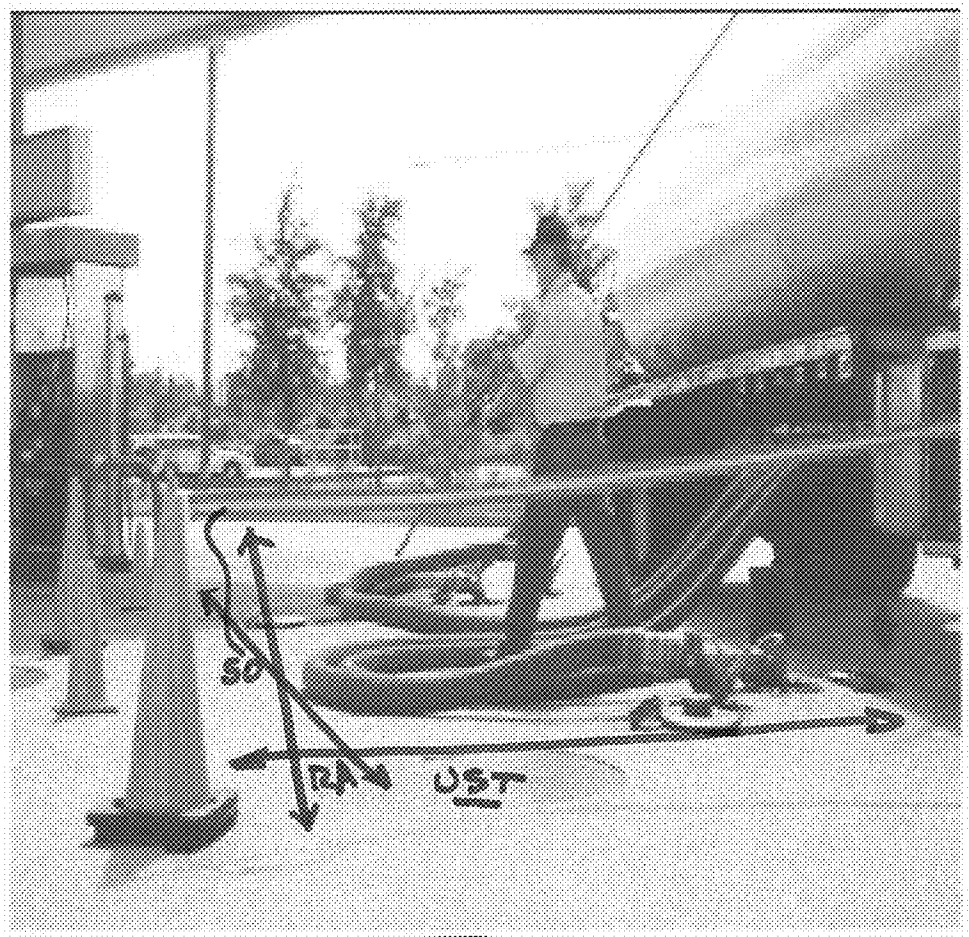
FIG. 5 depicts a tanker truck driver delivering fuel to an underground storage tank while working within the restricted access area defined by the present invention.

A brake housing 44 has a slit opening 46 and is positioned on said one or more sidewalls 16, the slit communicating with said inner cavity. A pair of strap rollers 48 is positioned in said brake housing spaced apart so that an imaginary plane passing through the slit opening extends therebetween. A strap 50 has a first end (not shown) secured to said axial shaft 26 by said strap anchor plate 35, said strap being wound on said spool 24 and having a second end 52 passing outwardly from said outer housing through the slit opening along the imaginary plane extending between said strap rollers. A biasing member 54, preferably a torsion spring, urges at least one roller in said pair of strap rollers 48 toward contacting the other roller in the pair so as to provide a frictional braking action against said strap 50. A manually actuated member 56 extends outwardly from said outer housing and is connected to the at least one roller 48 urged by said biasing member 54 so as to optionally discontinue the braking action. A connector 58 is positioned at a second end of said strap 50 and outside said outer housing 12 so as to allow said strap to be releasably connected to a support. As noted above, these structural features of the present tanker truck accessory are shown in the exploded view provided in FIG. 2. The frictional braking action, when applied, serves to relieve spring tension on the warning strap so that the strap exerts little pull on whatever support the second end 52 is connected to. For example, as shown in FIGS. 4 and 5, the tanker truck driver may elect to hook strap end 52 to a common traffic cone which due to its generally light weight, would tend to be pulled over were the strap under continuous spring tension. When the brake is released, either manually by actuation of member 56 or automatically by extending the strap to its limit, the strap will be retracted into housing 12 by action of spring coil 42 on the spool shaft 26. A spring coil 42 strong enough to automatically retract a fully extended strap 50 will generate sufficient force to knock down a typically traffic cone that the strap may be secured to, unless the strap has a brake applied to it to release the tension, as in the present invention. Rotatable member 38 may be used to manually rewind the strap 50 in the event spring coil 42 fails to automatically retract the strap.

The skilled will recognize that the strap is preferably made of a strong, weather and chemical resistant material, and particularly resistant to petroleum products, such as heavy gauge polyester weave. The strap material preferably includes at least a reflective section to improve visibility of the strap under vehicle headlamp illumination. Moreover, the strap could bear indicia such as a trademark, or warnings such as "no smoking" or "do not enter." The connector 58, shown in FIGS. 1 and 2 to be a hook-like device, is best made of a material which resists generating sparks. Connector 58 could include a magnet to aid in connecting the end of the strap to a ferrous metallic object such as a lamp post. A hook style connector 58 is useful in connecting the strap to a traffic cone, as shown in the figures.

In another embodiment, the tanker truck accessory 10 comprises an outer housing 12 having an inner cavity 14 defined by one or more side walls 16, a bottom cover 18, a top cover 20 and a plurality of openings 22 extending through said outer housing to therein receive a plurality of fasteners. A spool 24 is rotatably supported within the inner cavity 14 of said outer housing 12. A first biasing member 42 is engaged with said spool 24 so as to bring a biasing force to bear rotatably thereon. A slit 46 opening provides an outlet from said inner cavity 14 and a strap 50 is secured to and wound on said spool 24 having a free end 52 passing outwardly through said slit opening. A pair of frictional members 48 are disposed flanking said slit 46 opening, at least one frictional member of the pair being biased into the other member of the pair so as to constitute a frictional brake operable on said strap 50. A manual brake actuator 56 is connected to at least one of said pair of frictional members 48 so as to manually engage or disengage the frictional brake and a connector 58 is positioned at a free end of said strap outside said outer housing.

Figure 6:
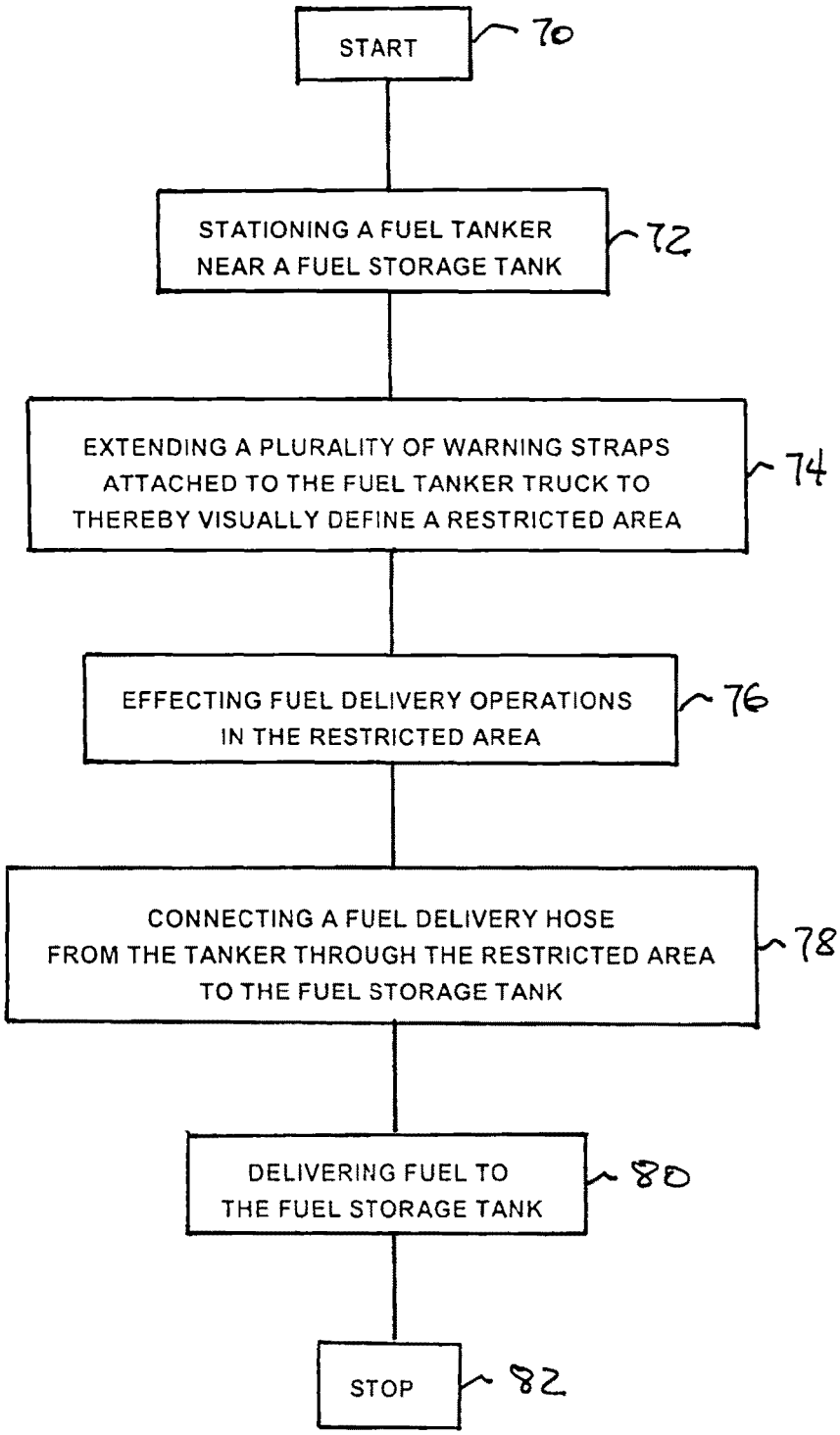
FIG. 6 is a flow diagram illustrating a method of the present invention.

Yet another embodiment of the invention, as shown in FIGS. 4-5 and illustrated in the flow diagram of FIG. 6, provides for a method of resupplying an automotive service station with fuel. The method comprises, from the start 70, stationing a fuel tanker truck 72 in the service station near a fuel storage tank. The method calls for visually defining a restricted area (RA) by extending a plurality of warning straps 74 attached to the fuel tanker truck so as to cordon-off and prevent motor vehicle access to a fuel delivery operations area. Fuel delivery operations are effected through the restricted area 76 by connecting a fuel delivery hose is from the tanker through the restricted area to the fuel storage tank 78 and fuel is delivered to the fuel storage tank 80. Thereafter, the method stops 82.

Yet a further embodiment and variations of the method of the invention includes delivering fuel to a storage tank. This embodiment comprises stationing near the storage tank a fuel tanker truck carrying fuel delivery hoses and having attached to the truck a plurality of spools of warning strap. One or more warning straps from the spools are extended so as to define a fuel delivery operations area between the tanker truck and the storage tank and restrict passage therethrough. The method continues by connecting a fuel delivery hose from the tanker truck to the storage tank so that the hose extends through the fuel delivery operations area and delivering fuel through the hose to the storage tank.

All these embodiments of the invention have in common the use of a warning strap contained on an accessory spool mounted on the vehicle. The strap is pulled in a direction away from the vehicle and generally toward the storage tank being replenished, the extending strap visually defining a prohibited access area wherein the fuel delivery operations take place.

The present invention, particularly the method of visually defining a restricted access area, is applicable as well to an emergency vehicle such as a fire engine, ambulance, wrecker, tow truck, utility service truck and other similar vehicles lawfully authorized to display flashing emergency lights, whether red, blue or yellow. These vehicles typically must stop on or along streets and highways in order to render the assistance they provide. In order to do so, the personnel operating these vehicles generally must work in proximity to the emergency vehicle and often on the road surface and very close to oncoming vehicular traffic. The invention would, advantageously, provide emergency personnel with the means to easily and quickly cordon-off an area restricted to vehicular traffic and thereby increase the safety of the workers by reducing the chance that an inattentive driver's vehicle would traverse the area of emergency operations.

Accordingly, in the drawings and specification there have been disclosed typical preferred embodiments of the invention and although specific terms may have been employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An accessory vehicle, said accessory comprising:

an outer housing having an inner cavity defined by one or more side walls, a bottom cover, a top cover and a plurality of openings extending through said outer housing to therein matingly receive a plurality of fasteners;

a spool having an axial shaft and top and bottom spaced apart endplates, said shaft having a center portion between said endplates, a top end extending through an opening in the top cover and a bottom end rotatably associated with the bottom cover so as to support said spool within the inner cavity of said outer housing;

a strap anchor plate associated with the center portion of the axial shaft of said spool;

top and bottom bearings concentrically disposed respectively on the top and bottom shaft ends between the spool endplates and the associated top and bottom outer housing covers so as to aid said spool to rotate about the axial shaft;

a thumbwheel attached to a spool shaft end which extends through the top cover so as to permit manual rotation of said spool;

a coil spring housing concentrically disposed on the bottom end of said axial shaft between the bottom spool endplate and the bottom bearing;

a coil spring positioned in said coil spring housing and engaged with said axial shaft so as to bring a biasing force to bear thereon;

a brake housing having a slit opening and positioned on said one or more sidewalls, the slit communicating with said inner cavity;

a pair of strap rollers positioned in said brake housing spaced apart so that an imaginary plane passing through the slit opening extends therebetween;

a strap having a first end secured to said axial shaft by said strap anchor plate, said strap wound on said spool and having a second end passing outwardly from said outer housing through the slit opening along the imaginary plane extending between said strap rollers;

a biasing member urging at least one roller in said pair of strap rollers toward contacting the other roller in the pair so as to provide frictional braking action against said strap;

a manually actuated member extending outwardly from said outer housing and connected to the at least one roller urged by said biasing member so as to optionally permit manually disengaging the contact between said strap rollers so as to discontinue the braking action; and a connector positioned at a second end of said strap and outside said outer housing so as to allow said strap to be releasably connected to a support.

2. A vehicle accessory comprising:

an outer housing having an inner cavity defined by one or more side walls, a bottom cover, a top cover and a plurality of openings extending through said outer housing to therein receive a plurality of fasteners;

a spool rotatably supported within the inner cavity of said outer housing;

a first biasing member engaged with said spool so as to bring a biasing force to bear rotatably thereon;

a slit opening providing an outlet from said inner cavity;

a strap secured to and wound on said spool and having a free end passing outwardly through said slit opening;

a pair of frictional members flanking said slit opening, at least one frictional member of the pair being biased into the other member of the pair so as to constitute a frictional brake operable on said strap;

a manual brake actuator connected to at least one of said pair of frictional members so as to manually engage or disengage the frictional brake; and a connector positioned at a free end of said strap outside said outer housing.

* * * * *